United States Patent [19]

Suprunuk et al.

[11] 3,958,794

[45] May 25, 1976

[54] SLAT FOR CHAIN LINK FENCE

[76] Inventors: Peter Suprunuk; Alex Keseloff, both of 1424 S. Gerhart Ave., Commerce, Calif. 90022

[22] Filed: Jan. 14, 1975

[21] Appl. No.: 540,828

[52] U.S. Cl. ..... 256/34; 256/47

[51] Int. Cl.[2] ..... B21F 27/00

[58] Field of Search ..... 256/34, 33, 48, 47, 256/32, 58

[56] References Cited

UNITED STATES PATENTS

| | | | |
|---|---|---|---|
| 353,129 | 11/1886 | Gholson | 256/48 |
| 589,593 | 9/1897 | Clark | 256/58 |
| 621,496 | 3/1899 | Johnson et al. | 256/DIG. 3 |
| 683,800 | 6/1901 | Reavis | 256/48 |
| 1,484,949 | 2/1924 | Kitselman et al. | 256/58 |
| 3,712,590 | 1/1973 | Tochner | 256/34 |

*Primary Examiner*—Paul R. Gilliam
*Assistant Examiner*—Doris L. Troutman

[57] ABSTRACT

A fence slat or pickett for interweaving in a vertical orientation in mesh of a chain link fence where diamond shaped openings extend vertically. The slats have a width slightly less than half the breadth of the opening so as to clear bends of strands at the corners of the diamond shaped openings. Longitudinal side portions of the slats each have a strand receiving notch spaced from the end of the slat a distance less than the breadth of the slat and the slat is anchored to the mesh by bending either the left or right side corner over the strand of the topmost opening.

10 Claims, 8 Drawing Figures

SLAT FOR CHAIN LINK FENCE

The open character of a conventional chain link fence is such that for some purposes such for example as a wind break, or a deterent to vision, some sheet material needs to be attached to the mesh. Chain link fences have the advantage of being strong, durable, easy to erect, and readily adjustable to different forms and heights and as such afford a basic structure which can be taken advantage of.

Most frequently the mesh of a chain link fence consists of strands woven in a diamond pattern and the fence is normally stretched with the axes running corner to corner of the diamond pattern extending vertically and horizontally. The invention here under consideration is particularly applicable to the diamond mesh chain link fence rather than to fences where the pattern is rectangular.

Sundry types of slats have been devised for insertion in the mesh of a chain link fence but for the most part those which have been acceptable are relatively wide slats designed to extend through the mesh in a diagonal direction. Although this is somewhat economical of material it presents a problem in retention of the slats and the interweaving of them through the strands of the mesh. A few attempts have been undertaken to employ vertically extending slats but here again employment of slats in such an orientation has presented problems in interlocking the slats to the mesh. For such expedients to be economically feasible slats not only have to be inexpensive but must also be capable of being attached quickly and inexpensively as well as with dependable security.

For those patents heretofore treating with these problems attention is directed to U.S. Pat. Nos. 3,356,343; 3,355,150; 3,069,142; 2,954,964; 2,760,759; and 3,572,640.

It is therefore among the objects of the invention to provide a new and improved fence slat or pickett for interweaving in a vertical direction in the mesh of a chain link fence which is capable of easy attachment for anchoring it in place and which at the same time presents a very neat appearance at the point of attachment.

Another object of the invention is to provide a new and improved fence slat for interweaving in a vertical orientation in the mesh of a chain link fence which is rigid, neat in appearance, and relatively inexpensive to manufacture and install.

Still another object of the invention is to provide a new and improved fence slat for interweaving in a vertical direction in the mesh of a chain link fence of such construction that the slats are uniform in size and construction whether used for a left side or right side position of attachment.

Still further among the objects of the invention is to provide a new and improved fence structure wherein each diamond pattern of a chain link fence is provided with a pair of parallel latterly spaced slats interlocked throughout the height of the fence and anchored at the topmost strands of the fence in a relationship presenting a trim neat appearance with abundant coverage of the mesh by the slats.

With these and other objects in view, the invention consists of the construction, arrangement, and combination of the various parts of the device, whereby the objects contemplated are attained, as hereinafter set forth, pointed out in the appended claims and illustrated in the accompanying drawings.

Figure 1:
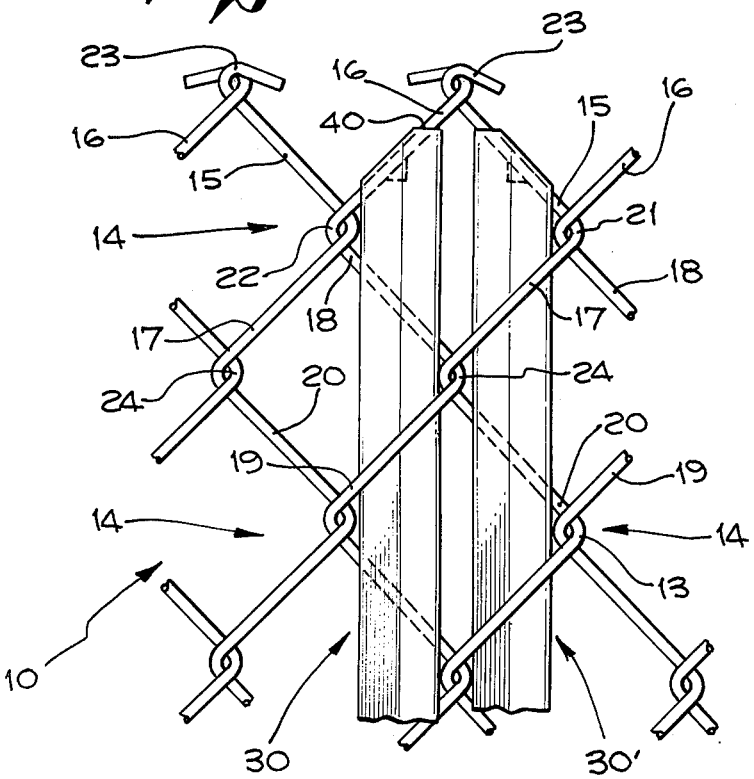
FIG. 1 is a fragmentary front elevational view of a section of chain link fence including a front elevational view of two of the slats.
Figure 2:
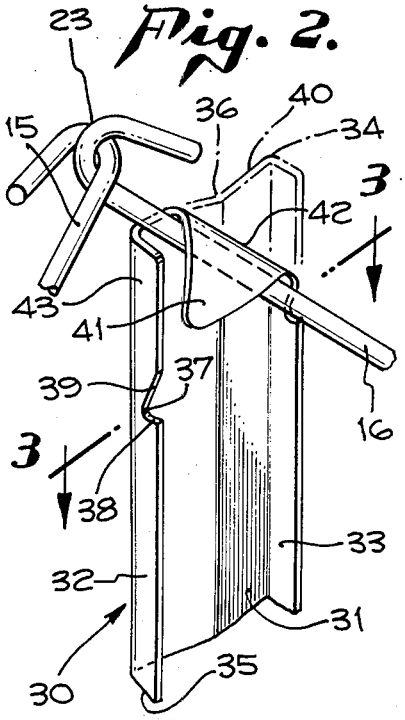
FIG. 2 is a perspective view of one of the slats taken from the rear to show the fastening expedient.
Figure 3:
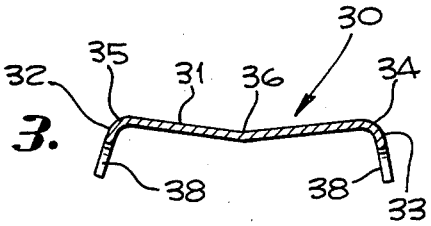
FIG. 3 is a cross sectional view on the line 3—3 of FIG. 2.

In an embodiment of the invention chosen for the purpose of illustration there is shown a substantially conventional chain link fence indicated generally by the reference character 10 wherein the mesh is supported in a conventional manner (not shown). The mesh consists of strands 13 interwoven so as to provide diamond mesh patterns 14 wherein vertical axes extend corner to corner of the patterns and horizontal axes extend through the other corners of each pattern.

When the diamond patterns are in the orientation described each of the uppermost diamond patterns has two oblique upper side strands 15 and 16 and two oblique lower side strands 17 and 18. For the second level of diamond mesh patterns downward from the top the lower side strands 17 and 18 of the uppermost diamond shaped patterns form the upper side strands and additional lower side strands 19 and 20 form the lower sides of the row of patterns second from the top, and so on throughout the height of the fence. The strands are bent around each other forming horizontally located corners 21 and 22 for the topmost patterns 14 and vertically located corners 23 and 24 for the same uppermost diamond mesh patterns. Only the uppermost level of diamond shaped patterns have been completely numbered because of the alternating positioning of the other diamond mesh patterns which repeat in alternating positions throughout the height of the diamond mesh chain link fence.

One form of slat or picket is indicated generally by the reference character 30 and consists of a base portion 31 to form respective side flanges 32 and 33. The face portion is dished in the form made reference to whereby to form a vertically extending ridge 36 for stiffening. Corners 34 and 35 are rounded.

In each of the side portions there is provided a notch 37 which has a depth preferably somewhat greater than the diameter of the mesh with which the slat is to be used. The notch is formed with a horizontal shoulder 38 at the bottom and an oblique sloping wall 39 at the top. It is of significance that the location of the horizontal shoulder 38 is at a distance from an end edge 40 of the slat somewhat less than the breadth of the slat as a whole. What this means is that when a corner portion 41 of the slat is bent over as it may be when being attached to the chain mesh a fold-line 42 will intersect the end edge 40 spaced horizontally inwardly from the opposite side of the slat, thereby leaving a portion of the horizontal end edge 40 in position after the attaching operation has been accomplished.

When for example the slat 30 is to be put in position with respect to the diamond pattern mesh it is interwoven from the top downwardly, overlying the upper side strand 16, overlying the lower side strand 18 and then underlying the next lower side strand 19. It will be noted that the overall breadth of the slat 30 is less than half the distance through the center of the diamond pattern 14 so that one side edge of the slat 30 comfortably clears the corner 22 and the other side edge comfortably clears the corner 24.

In this position, the upper end of the slat 30 has its notch 37 in engagement beneath the upper side strand 16. When in this position a segment 43 lying between the notch and the end edge 40 overlies the upper side strand 16 and this segment is bent together with an appropriate corner portion 41 along the fold line 42 to envelope the upper side strand 16. When this has been accomplished the remaining horizontal portion of the upper edge 40 will be visible but relatively short and at a location close to the vertically located corner 23.

A slat 30' which is identical with respect to slat 30 is then slid into engagement with the wire mesh by extending it downwardly from the same upper-most wire mesh pattern 14 but on the other side of the pattern as viewed in FIG. 1. In this instance the slat 30' overlies the upper side strand 15, underlies the lower side strand 17 immediately below it and then overlies the side strand 20 next below and, so on throughout the height of the fence.

Because of its breadth the slat 30' has its left side edge located clear of and spaced from the right side edge of the slat 30. The right side edge of the slat 30 similarly clears the horizontally located corner 21 and the vertically located corner 24, by the same amount as the slat 30 cleared the corners on the opposite side of the diamond mesh pattern 14.

On this occasion the notch 37 on the side portion 32 to the right engages beneath the upper side strand 15 and the corresponding corner portion of the slat 30' is then folded over the upper side strand 15 interlocking the slat with the strand.

The remaining portions of the fence are duplications of the pair of slats and their arrangement just described.

In this form of the slat it will be clear that the segments 43 are materially helpful in the folded over position for assisting in the interlocking relationship.

Figure 4:
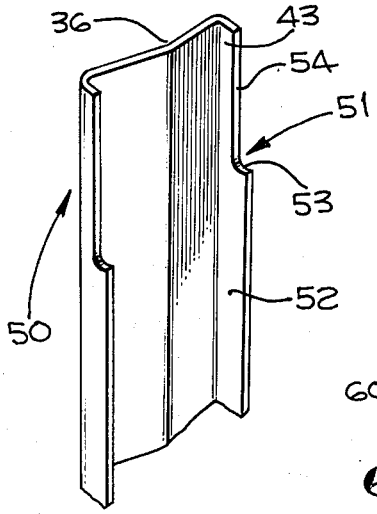
FIG. 4 is a rear perspective view of a second form of the invention.

In a second form of the invention illustrated in FIG. 4 a slat 50 is provided with a notch 51 in a side portion, flange, or leg 52. The notch has a horizontal lower shoulder 53 and a straight vertical edge 54. By cutting away the uppermost end of the side portion 52, when the adjacent corner portion of the slat is folded over into engaged position with the upper side strand the fold over can at times be quickly and easily accomplished by reason of part of the metal being cut away.

Figure 5:
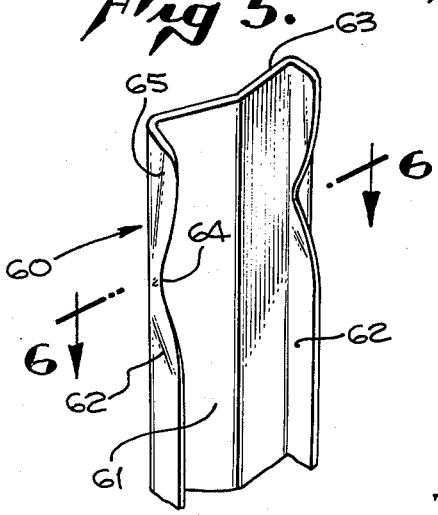
FIG. 5 is a rear perspective view of a third form of the invention.

In the formed slat 60 of FIG. 5 there is as customary a face portion 61 and side portions or flanges 62. At a proper distance downwardly from the upper edge 63 there is formed a notch 64, at the same relative position as the notches 37 and 51 heretofore described. In this instance the notch is formed by merely indenting the edge of the side portion without any portion being cut away, sections of the side portion which are displaced being merely rough folded over inwardly with respect to the side portion. By making the notch deep enough it is capable of effectively interlocking with the appropriate upper side strand of the uppermost diamond mesh pattern in much the same fashion as has already been described. In this form of device a segment 65 is additionally strengthened by the folding over of the edge and when this is folded over the respective upper side strand an especially secure interlock is accomplished.

Figure 7:
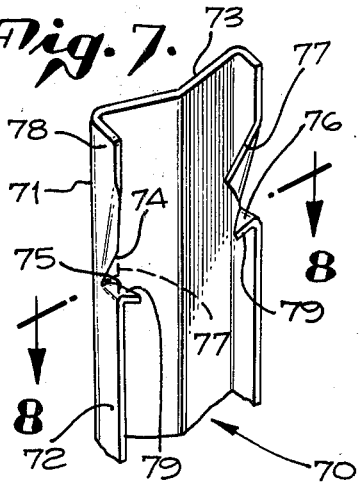
FIG. 7 is a rear perspective view of a fourth form of the invention.
Figure 6:
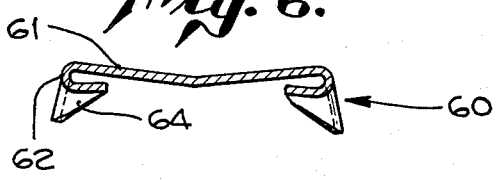
FIG. 6 is a cross sectional view on the line 6—6 of FIG. 5.
Figure 8:
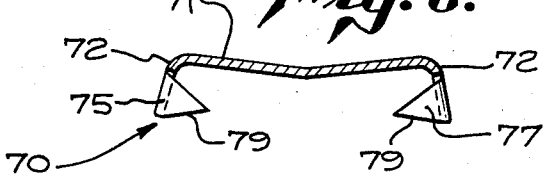
FIG. 8 is a cross sectional view on the line 8—8 of FIG. 7.

Still another form a slat 70 is shown in FIG. 7, of substantially the same general construction as those previously described consisting of a face portion 71, side portions 72, and an upper end edge 73. A notch 74 in this form of device is formed by providing a cut 75 indicated by the dotted line and a tab 79 then folding over adjacent parts of the material of the side portion to form a shoulder 76 on the lower side and an oblique edge 77 on the upper side. In this form the segment 78 is additionally reinforced by the folded-over part which makes the oblique edge 77 thereby to improve the engagement of the slat 70 with respective other side strand, when the slat is attached to the mesh.

Since the diamond mesh pattern sizes vary to some degree depending on whether the mesh is to be light or heavy, it may be necessary to provide slats of different physical dimensions in order to make certain that the width of the slats in each case is something less than half the transverse dimension of the diamond mesh pattern with which it is to be used. By the same token, for light weight slats used with a fence where the mesh is small, slats 50 with the cut away side portion may be appropriate, with or without employment of a central stiffening ridge 36. For slats of greater transverse dimension to fit diamond mesh patterns which are larger the stiffer forms such as the slats 30, 60, and 70 may be preferable.

Having described the invention what is claimed as new in support of Letters Patent is as follows:

1. A slat for insertion in vertical orientation in a chain link fence wherein strands make a diamond pattern mesh with vertical axes passing corner to corner, each said slot comprising a single piece of sheet metal of uniform thickness and having a longitudinally extending side portion at each side edge, said slat having a breadth less than half the greatest transverse width of the diamond pattern, means forming a notch in each side portion spaced from the nearest end a distance less than the breadth of the slat for engagement beneath the nearest adjacent strand when a corresponding corner of the slat has a position folded over said nearest adjacent strand, there being an opening between the folded over corner and an adjacent end edge of the respective side portion through which a strand of the fence is adapted to pass.

2. A slat as in claim 1 wherein the end of the slat nearest the notch has an end edge extending in a direction 90° relative to the long dimension of the slat.

3. A slat as in claim 1 wherein there is a notch in each of said side portions at the same relative location.

4. A slat as in claim 1 wherein the slat has a central portion extending substantially in a plane parallel to the plane of the fence and the side portions are flanges each joined at one side edge to a corresponding side edge of the central portion and extending transversely relative to the plane of the central portion.

5. A slat as in claim 4 wherein the central portion has a longitudinal stiffening rib extending in the same direction as said flanges.

6. A slat as in claim 1 wherein the notch is a cut out portion of the side portion.

7. A slat as in claim 1 wherein the notch is an indented portion of the side portion.

8. A slat as in claim 1 wherein the notch comprises folded over portions of the side portion.

9. A fence structure comprising a chain link fence wherein strands are woven in the form of a diamond pattern mesh with one set of vertical axes passing corner to corner of the diamond pattern and another set of horizontal axes passing corner to corner of the diamond pattern, lower side strands of each diamond pattern having alternate outward and inward locations and upper side strands of each diamond pattern having respective alternate inward and outward locations, individual slats of sheet material having identical upper ends and having a breadth less than half the width of the diamond pattern along the horizontal axis, said diamond patterns having two slats extending therethrough in positions alternately overlying and underlying respective upper and lower side strands of the patterns, each slat being in alternate position with respect to the next adjacent slats, each slat having a longitudinally extending side portion at each side edge, said slats having horizontal upper edges, means forming a notch in each side portion spaced from said upper edge a distance less than the breadth of the slat, one of said notches being in engagement beneath the adjacent upper side strand of the uppermost diamond pattern, the corner portion of the slat adjacent the notch which is in engagement with said upper side strand having a position folded over said upper side strand in interlocked relationship.

10. A fence structure as in Claim 9 wherein the slats are at vertical parallel spaced locations with adjacent slats on opposite sides of strands where they form corners of the diamond patterns, one of the corner portions of one of the slats in one of said uppermost diamond patterns having a position folded over one of said upper side strands and one of the corner portions of the other slat in said one uppermost diamond pattern having a position folded over the other of said upper side strands.

* * * * *